US005996254A

United States Patent [19]

Goven

[11] Patent Number: 5,996,254

[45] Date of Patent: Dec. 7, 1999

[54] INFLATABLE INSOLE SYSTEM

[76] Inventor: Michael Goven, 6033 34th W. #85, Bradenton, Fla. 34210

[21] Appl. No.: 09/262,199

[22] Filed: Mar. 4, 1999

[51] Int. Cl.[6] ..... A43B 13/38; A43B 7/14

[52] U.S. Cl. ..... 36/43; 36/29; 36/153

[58] Field of Search ..... 36/43, 44, 29, 36/153, 88

[56] References Cited

U.S. PATENT DOCUMENTS

| | | | |
|---|---|---|---|
| 1,145,533 | 7/1915 | Wetmore | 36/153 |
| 2,488,382 | 11/1949 | Davis | 36/153 |
| 3,990,457 | 11/1976 | Voorhees | 36/153 |
| 4,115,934 | 9/1978 | Hall | 36/29 |
| 4,744,157 | 5/1988 | Dubner | 36/29 |
| 5,117,566 | 6/1992 | Lloyd | 36/29 |

*Primary Examiner*—M D Patterson

[57] ABSTRACT

A inflatable insole system for placement in an article of footwear for providing added comfort to the foot of a user comprises an inflatable flexible bottom cell with a plurality of upwardly extending inflatable cells. The plurality of inflatable cells include a heel middle cell, a mid-foot middle cell, a toe middle cell, a heel upper cell, a mid-foot upper cell, and a toe upper cell.

6 Claims, 3 Drawing Sheets

30
24
26
14
25
27a
27c 24
21
27d
27c
25
27b
27a

INFLATABLE INSOLE SYSTEM

BACKGROUND OF THE INVENTION

1. Field of the Invention

The present invention relates to insoles for footwear and more particularly pertains to a new inflatable insole system for placement in an article of footwear for providing added comfort to the foot of a user.

2. Description of the Prior Art

The use of insoles for footwear is known in the prior art. More specifically, insoles for footwear heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,406,719 by Potter; U.S. Pat. No. 5,335,430 by Fiso et al.; U.S. Pat. No. Des. 288,383 by Autry; U.S. Pat. No. 5,353,252 by Grim; U.S. Pat. No. 5,222,312 by Doyle; and U.S. Pat. No. 5,113,599 by Cohen et al.

While these devices fulfill their respective, particular objectives and requirements, the aforementioned patents do not disclose a new inflatable insole system. The inventive device includes an inflatable flexible bottom cell with a plurality of upwardly extending inflatable cells. The plurality of inflatable cells include a heel middle cell, a mid-foot middle cell, a toe middle cell, a heel upper cell, a mid-foot upper cell, and a toe upper cell.

In these respects, the inflatable insole system according to the present invention substantially departs from the conventional concepts and designs of the prior art, and in so doing provides an apparatus primarily developed for the purpose of placement in an article of footwear for providing added comfort to the foot of a user.

SUMMARY OF THE INVENTION

In view of the foregoing disadvantages inherent in the known types of insoles for footwear now present in the prior art, the present invention provides a new inflatable insole system construction wherein the same can be utilized for placement in an article of footwear for providing added comfort to the foot of a user.

The general purpose of the present invention, which will be described subsequently in greater detail, is to provide a new inflatable insole system apparatus and method which has many of the advantages of the insoles for footwear mentioned heretofore and many novel features that result in a new inflatable insole system which is not anticipated, rendered obvious, suggested, or even implied by any of the prior art insoles for footwear, either alone or in any combination thereof.

To attain this, the present invention generally comprises an inflatable flexible bottom cell with a plurality of upwardly extending inflatable cells. The plurality of inflatable cells include a heel middle cell, a mid-foot middle cell, a toe middle cell, a heel upper cell, a mid-foot upper cell, and a toe upper cell.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new inflatable insole system apparatus and method which has many of the advantages of the insoles for footwear mentioned heretofore and many novel features that result in a new inflatable insole system which is not anticipated, rendered obvious, suggested, or even implied by any of the prior art insoles for footwear, either alone or in any combination thereof.

It is another object of the present invention to provide a new inflatable insole system which may be easily and efficiently manufactured and marketed.

It is a further object of the present invention to provide a new inflatable insole system which is of a durable and reliable construction.

An even further object of the present invention is to provide a new inflatable insole system which is susceptible of a low cost of manufacture with regard to both materials and labor, and which accordingly is then susceptible of low prices of sale to the consuming public, thereby making such inflatable insole system economically available to the buying public.

Still yet another object of the present invention is to provide a new inflatable insole system which provides in the apparatuses and methods of the prior art some of the advantages thereof, while simultaneously overcoming some of the disadvantages normally associated therewith.

Still another object of the present invention is to provide a new inflatable insole system for placement in an article of footwear for providing added comfort to the foot of a user.

Yet another object of the present invention is to provide a new inflatable insole system which includes an inflatable flexible bottom cell with a plurality of upwardly extending inflatable cells. The plurality of inflatable cells include a heel middle cell, a mid-foot middle cell, a toe middle cell, a heel upper cell, a mid-foot upper cell, and a toe upper cell.

Still yet another object of the present invention is to provide a new inflatable insole system that includes a syringe for injecting air into in inflatable cells of the insole to inflate and deflate the inflatable cells to suit the needs of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 6 thereof, a new inflatable insole system embodying the principles and concepts of the present invention will be described.

As best illustrated in FIGS. 1 through 6, the inflatable insole system generally comprises an inflatable flexible bottom cell with a plurality of upwardly extending inflatable cells. The plurality of inflatable cells include a heel middle cell, a mid-foot middle cell, a toe middle cell, a heel upper cell, a mid-foot upper cell, and a toe upper cell.

In closer detail, the inflatable insole 10 comprises an inflatable flexible bottom cell 11 has a foot-shaped outer perimeter, opposite heel and toe ends 12,13, a heel region, a mid-foot region and a toe region. The heel region of the bottom cell is positioned adjacent the heel end of the bottom cell. The toe region of the bottom cell is positioned adjacent the toe end of the bottom cell. The mid-foot region of the bottom cell is interposed between the heel and toe regions of the bottom cell.

Figure 3:
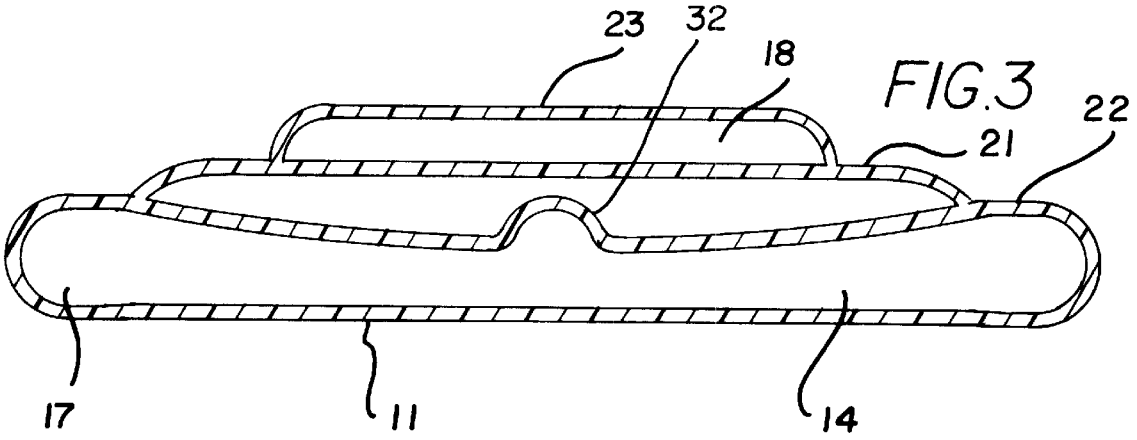
FIG. 3 is a schematic cross-sectional view of the present invention taken from line 3—3 of FIG. 2.
Figure 4:
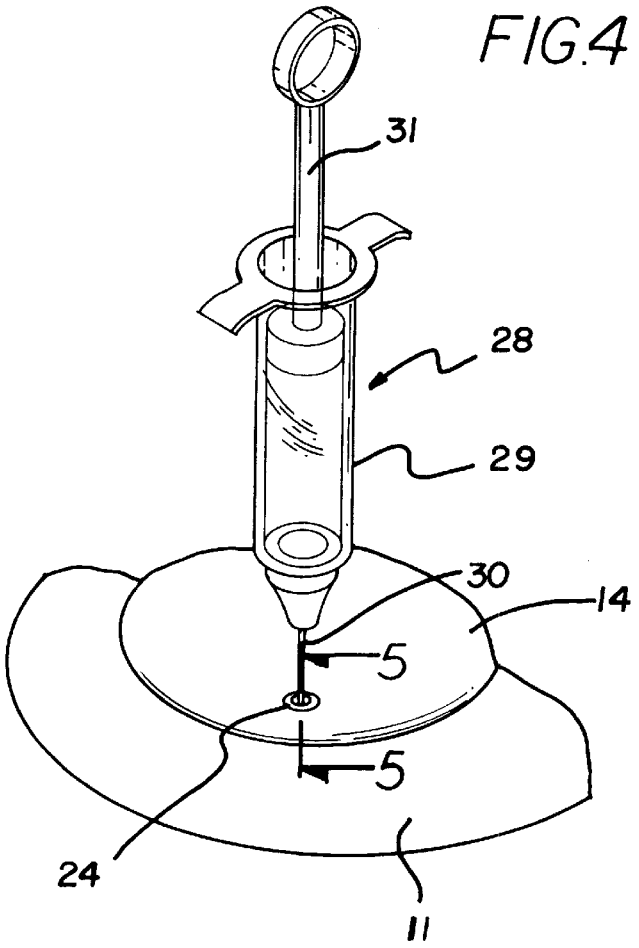
FIG. 4 is a schematic partial perspective view of the present invention illustrating the insertion of the needle of the syringe in one of the inflatable cells.

A plurality of distinct inflatable cells are upwardly extended from the bottom cell. Each of the inflatable cells (including the bottom inflatable cell) is inflatable with air or a fluid to provide cushion to the insole for providing cushioning to the appropriate adjacent regions of a user's foot on the insole. As best shown in FIG. 3, the walls of the inflatable cells form an impermeable barrier between inflatable cells so that fluid and air may not pass between individual inflatable cells.

The plurality of inflatable cells include a heel middle cell 14, a mid-foot middle cell 15, and a toe middle cell 16. The heel middle cell is positioned in the heel region of the bottom cell. The toe middle cell is positioned in the toe region of the bottom cell. The mid-foot middle cell is positioned in the mid-foot region of the bottom cell. The heel, mid-foot, and toe middle cells are spaced apart from one another with the mid-foot middle cell interposed between the heel and toe middle cells.

Figure 2:
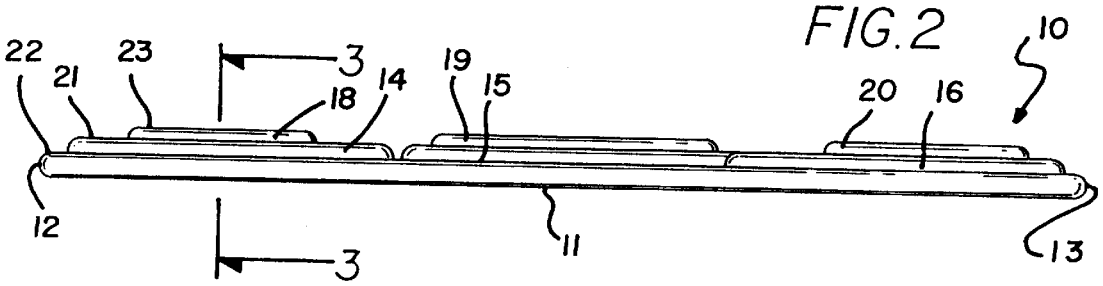
FIG. 2 is a schematic side view of the present invention.

The plurality of inflatable cells also include a plurality of upper cells including a heel upper cell 18, a mid-foot upper cell 19, and a toe upper cell 20. The heel upper cell is upwardly extended from the heel middle cell. The mid-foot upper cell is upwardly extended from the mid-foot middle cell. The toe upper cell is upwardly extended from the top middle cell. With reference to FIGS. 2 and 3, the inflatable cells each has an upper face. The upper faces 21 of the middle cells each lie in planes positioned above a plane in which the upper face 22 of the surrounding cell lies. The upper faces 23 of the upper cells each lie in planes positioned above the associated middle cell.

Preferably, as illustrated in FIG. 3, the upper faces of the middle cells each have an upwardly extending node 17. In use, the nodes are compressed when downwards pressure is applied on the associated adjacent upper cell for providing more comfort to the foot of the user.

Figure 1:
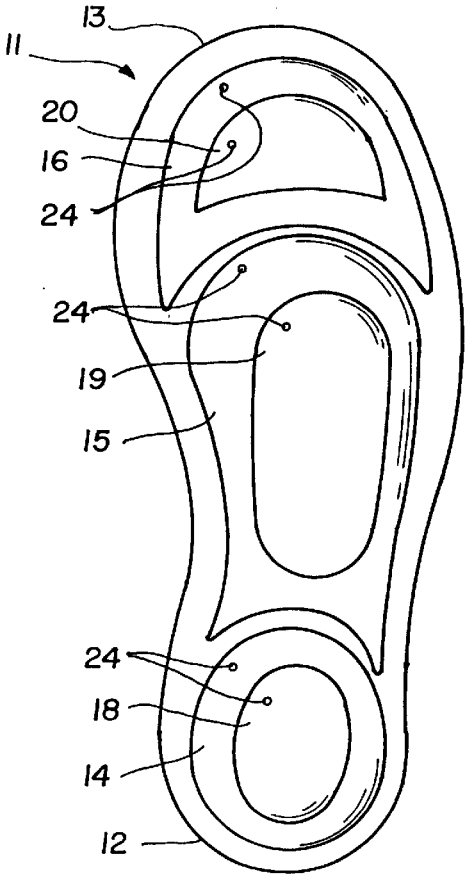
FIG. 1 is a schematic top view of a new inflatable insole system according to the present invention.

As best shown in FIG. 1, the toe middle cell and the toe upper cell each have a generally crescent-shaped outer perimeter, with the toe upper cell having a more triangular configuration than the toe middle cell. In use, the toe middle cell and the toe upper cell are designed for optimally cushioning the toe region of a user's foot thereon. The mid-foot middle cell has a generally D-shaped outer perimeter and the mid-foot upper cell has a generally oval-shaped outer perimeter. In use, the mid-foot middle cell and the mid-foot upper cell are designed for optimally cushioning the mid-foot region of a user's foot thereon. The heel middle cell and the heel upper cell each has a generally oval-shaped outer perimeter. In use, the heel middle cell and the heel upper cell are designed for optimally cushioning the heel region of a user's foot thereon.

Figure 5:
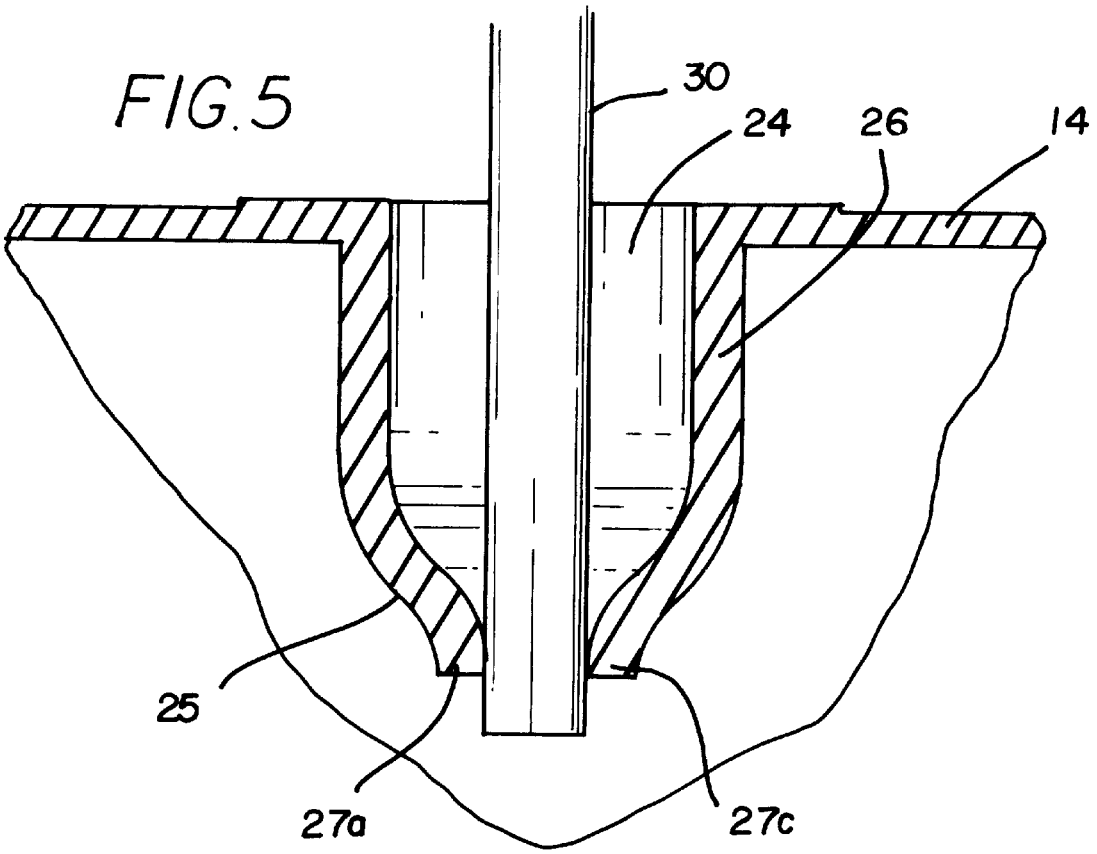
FIG. 5 is a schematic cross-sectional view of the present invention taken from line 5—5 of FIG. 4.
Figure 6:
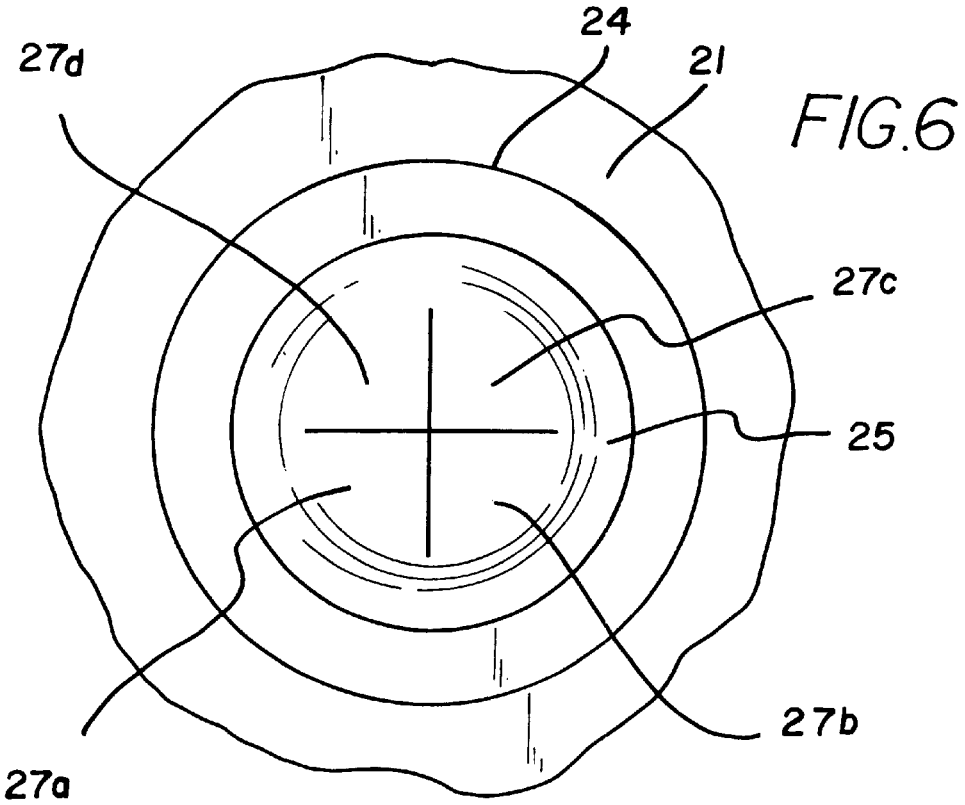
FIG. 6 is a schematic top view of a recess of an inflatable cell of the present invention.

The bottom, middle each preferably have a closable aperture therein to permit inflation and deflation of the respective cell. Optionally, the upper cells may also each have a closing aperture therein to permit inflation and deflation thereof. Ideally, the bottom, middle and upper cells each have a generally cylindrical recess 24 on an upper face of the respective inflatable cell. As illustrated in FIGS. 5 and 6, each recess has a generally circular bottom wall 25 and a generally cylindrical side wall 26 upwardly extending around the bottom wall of the respective recess. The bottom walls of the recesses each comprise a plurality of resilient flaps 27*a*,27*b*,27*c*,27*d* that form a valve to substantially close the opening of the associated inflatable cell. The flaps of each bottom wall are resiliently deflectable to spread the flaps apart to permit opening of the aperture of the associated inflatable cell as shown in FIG. 5.

Preferably, as illustrated in FIG. 3, the upper face of the surrounding cell has a plurality of upwardly extending nodes 32. Each of the nodes is positioned on the surround cell adjacent an associated middle cell such that each node upwardly extends towards the upper face of the associated middle cell. In use, the nodes are compressed by the upper face of the associated middle cells when downwards pressure is applied on the associated adjacent upper cell.

The system also includes a syringe 28 comprising a barrel 29, a hollow needle 30 in fluid communication with the barrel, and a plunger 31 slidably inserted into the barrel to force air from the barrel out through the needle. The needle of the syringe has a tip insertable into each of the openings of the cells (as shown in FIG. 5) to permit inflating and deflating of the respective inflatable cell with the syringe.

The bottom cell has a longitudinal axis extending between the heel and toe ends of the bottom cell. Each of the middle and upper cells has an outermost width defined perpendicular to the longitudinal axis of the bottom cell. Ideally, the outermost width of the heel middle cell is between about 2 inches and about 3 inches and the outermost width of the heel upper cell is between about 1 inch and about 1½ inches to provide optimal comfort to a user's heel.

In this ideal embodiment, the outermost width of the mid-foot middle cell is between about 3½ inches and about 4 inches and the outermost width of the mid-foot upper cell is between about 2 inches and about 3 inches to provide optimal comfort to the mid-foot region a user's foot. The outermost width of the toe middle cell is ideally between about 3 inches and about 4 inches and the outermost width of the mid-foot upper cell is ideally between about 1½ inches and about 3 inches to provide optimal comfort to a user's toes.

In this ideal embodiment, each of the bottom walls of the recesses preferably has a outer diameter of about 5 mm. Also in this ideal embodiment, the needle of the syringe preferably has a length between the barrel and the tip of the needle of about ½ inch so that the needle does not extend excessively far our to easily hurt a user accidentally when the user is handling the syringe.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An inflatable insole system, comprising:

an inflatable flexible bottom cell having a foot-shaped outer perimeter, opposite heel and toe ends, a heel region, a mid-foot region and a toe region;

said heel region of said bottom cell being positioned adjacent said heel end of said bottom cell, said toe region of said bottom cell being positioned adjacent said toe end of said bottom cell, said mid-foot region of said bottom cell being interposed between said heel and toe regions of said bottom cell;

a plurality of inflatable cells being upwardly extended from said bottom cell;

said plurality of inflatable cells including a heel middle cell, a mid-foot middle cell, and a toe middle cell;

said heel middle cell being positioned in said heel region of said bottom cell, said toe middle cell being positioned in said toe region of said bottom cell, said mid-foot middle cell being positioned in said mid-foot region of said bottom cell;

said heel, mid-foot, and toe middle cells being spaced apart from one another, said mid-foot middle cell being interposed between said heel and toe middle cells;

said plurality of inflatable cells including a plurality of upper cells, said upper cells including a heel upper cell, a mid-foot upper cell, and a toe upper cell; and said heel upper cell being upwardly extended from said heel middle cell, said mid-foot upper cell being upwardly extended from said mid-foot middle cell, and said toe upper cell being upwardly extended from said top middle cell.

2. The inflatable insole system of claim 1, wherein said inflatable cells each have an upper face, wherein said upper faces of said middle cells each lie in planes positioned above a plane in which said upper face of said bottom cell lies, and wherein said upper faces of said upper cells each lie in planes positioned above the associated middle cell.

3. The inflatable insole system of claim 1, wherein said bottom, middle and upper cells each have a closable aperture therein to permit inflation and deflation of the respective cell.

4. The inflatable insole system of claim 3, further comprising a syringe comprising a barrel, a needle in fluid communication with said barrel, and a plunger slidably inserted into said barrel, said needle of said syringe having a tip insertable into each of said openings of said upper, middle, and bottom cells to permit inflating and deflating of the respective inflatable cell with said syringe.

5. The inflatable insole system of claim 3, wherein said bottom, middle and upper cells each have a generally cylindrical recess on an upper face of the respective inflatable cell, wherein each recess has a generally circular bottom wall and a generally cylindrical side wall upwardly extending around said bottom wall of the respective recess, wherein said bottom walls of said recesses each comprise a plurality of resilient flaps substantially closing said opening of the associated inflatable cell, said flaps of each bottom wall being resiliently deflectable to permit opening of said aperture of the associated inflatable cell.

6. An inflatable insole system, comprising:

an inflatable flexible bottom cell having a foot-shaped outer perimeter, opposite heel and toe ends, a heel region, a mid-foot region and a toe region;

said heel region of said bottom cell being positioned adjacent said heel end of said bottom cell, said toe region of said bottom cell being positioned adjacent said toe end of said bottom cell, said mid-foot region of said bottom cell being interposed between said heel and toe regions of said bottom cell;

a plurality of inflatable cells being upwardly extended from said bottom cell;

said plurality of inflatable cells including a heel middle cell, a mid-foot middle cell, and a toe middle cell;

said heel middle cell being positioned in said heel region of said bottom cell, said toe middle cell being positioned in said toe region of said bottom cell, said mid-foot middle cell being positioned in said mid-foot region of said bottom cell;

said heel, mid-foot, and toe middle cells being spaced apart from one another, said mid-foot middle cell being interposed between said heel and toe middle cells;

said plurality of inflatable cells including a plurality of upper cells, said upper cells including a heel upper cell, a mid-foot upper cell, and a toe upper cell;

said heel upper cell being upwardly extended from said heel middle cell, said mid-foot upper cell being upwardly extended from said mid-foot middle cell, and said toe upper cell being upwardly extended from said top middle cell;

said inflatable cells each having an upper face, said upper faces of said middle cells each lying in planes positioned above a plane in which said upper face of said bottom cell lies;

said upper faces of said upper cells each lying in planes positioned above the associated middle cell said upper face of said surrounding cell having a plurality of upwardly extending nodes, each of said nodes being positioned on said surround cell adjacent an associated middle cell such that each node upwardly extends towards said upper face of the associated middle cell, said nodes being compressed by the upper face of the associated middle cells when downwards pressure is applied on the associated adjacent upper cell;

said bottom, middle and upper cells each having a closable aperture therein to permit inflation and deflation of the respective cell;

said bottom, middle and upper cells each having a generally cylindrical recess on an upper face of the respective inflatable cell;

each recess having a generally circular bottom wall and a generally cylindrical side wall upwardly extending around said bottom wall of the respective recess;

said bottom walls of said recesses each comprising a plurality of resilient flaps substantially closing said opening of the associated inflatable cell, said flaps of each bottom wall being resiliently deflectable to permit opening of said aperture of the associated inflatable cell; and a syringe comprising a barrel, a needle in fluid communication with said barrel, and a plunger slidably inserted into said barrel, said needle of said syringe having a tip insertable into each of said openings of said bottom, middle, and upper cells to permit inflating and deflating of the respective inflatable cell with said syringe.

* * * * *